US006513781B1

(12) United States Patent
Meyer et al.

(10) Patent No.: US 6,513,781 B1
(45) Date of Patent: Feb. 4, 2003

(54) SUPPORT DEVICES FOR THE VANES OF POWER UNITS

(75) Inventors: Heinz-Jurgen Meyer, Bremen (DE); Gerd Lunsmann, Ritterhude (DE)

(73) Assignee: ETN Präzisionstechnik GmbH, Bremen (DE)

( * ) Notice: Subject to any disclaimer, the term of this patent is extended or adjusted under 35 U.S.C. 154(b) by 0 days.

(21) Appl. No.: 09/529,389

(22) PCT Filed: Aug. 12, 1999

(86) PCT No.: PCT/EP99/05856

§ 371 (c)(1),
(2), (4) Date: Jun. 19, 2000

(87) PCT Pub. No.: WO00/09861

PCT Pub. Date: Feb. 24, 2000

(30) Foreign Application Priority Data

Aug. 12, 1998 (DE) ..... 198 36 400

(51) Int. Cl.[7] ..... F01D 1/02

(52) U.S. Cl. ..... 248/544; 248/544; 29/446; 415/209.3; 415/209.2; 415/200; 415/135

(58) Field of Search ..... 248/544; 29/446; 415/209.4, 209.3, 209.2, 200, 135, 138, 189

(56) References Cited

U.S. PATENT DOCUMENTS 1,551,342 A * 8/1925 Steenstrup ..... 415/209.4
5,421,703 A * 6/1995 Payling ..... 415/209.4
6,164,903 A * 12/2000 Kouris ..... 415/135

FOREIGN PATENT DOCUMENTS

DE 3402066 8/1985
DE 19711337 9/1998

* cited by examiner

*Primary Examiner*—Kimberly Wood
(74) *Attorney, Agent, or Firm*—Wood, Herron & Evans, L.L.P.

(57) ABSTRACT

The invention concerns an apparatus for supporting blades of axial-flow machines, in particular turbojet propulsion units, which is distinguished by at least one pair of mutually oppositely disposed support rings (12, 14) which are supported adjustably relative to each other for assembly between guide or rotor blades of adjacent compressor or turbine stages.

25 Claims, 3 Drawing Sheets

SUPPORT DEVICES FOR THE VANES OF POWER UNITS

FIELD OF THE INVENTION

Figure 1:
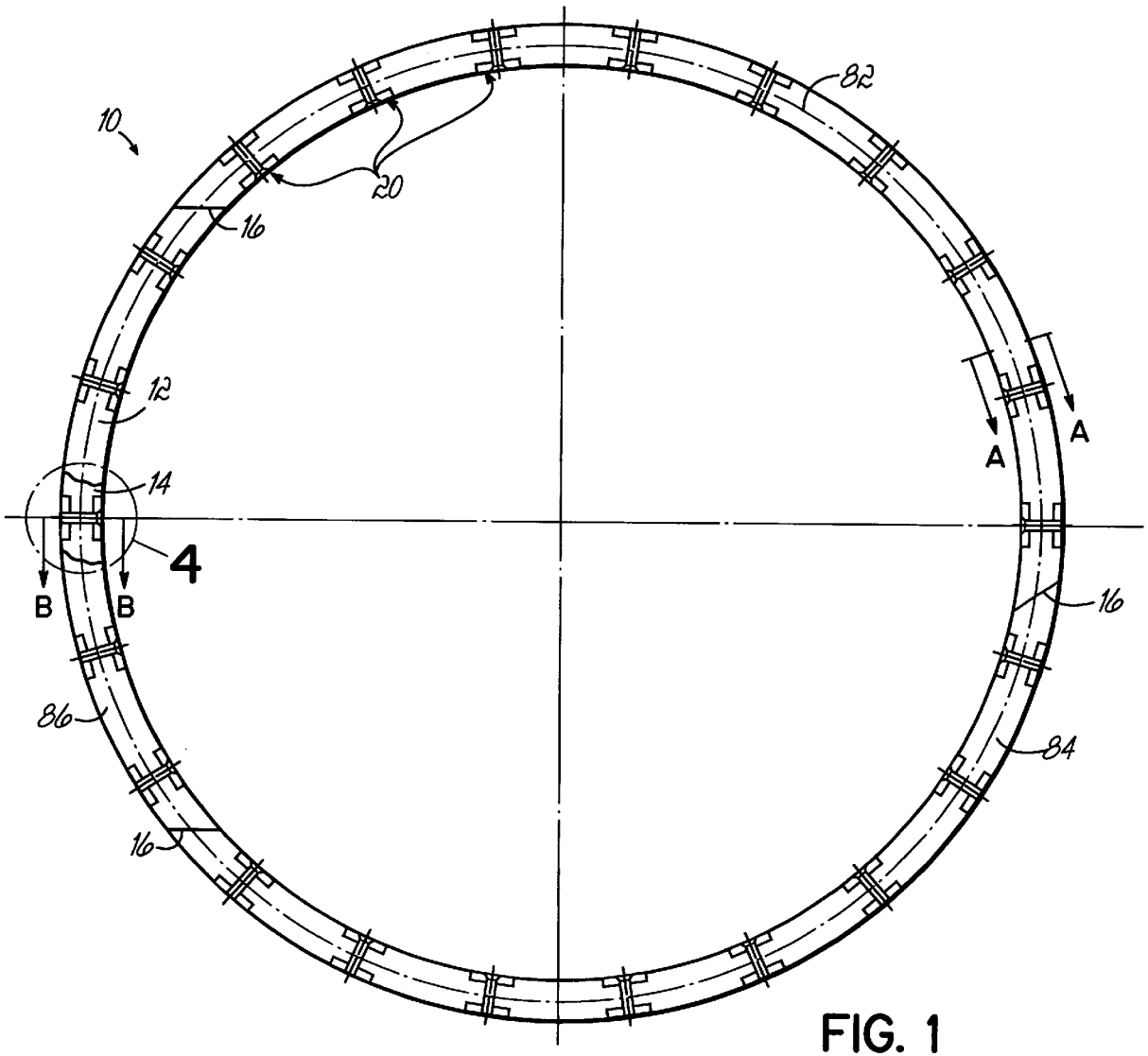

The invention concerns an apparatus for supporting blades of axial-flow machines, in particular turbojet propulsion units.

BACKGROUND OF THE INVENTION

Axial-flow machines are machines through which a fluid, for example a gas such as air, flows axially. Such machines have at least one rotor which is equipped with blades and which either gives off energy to the fluid by way of the blades and thus acts as a compressor or pump, or at the blades onto which the fluid performs work, this then involving a turbine. Both compressors and turbines are generally of a multi-stage construction. Each stage of such multi-stage axial-flow machines is formed by a plurality of rotor blades which are generally arranged in an annular configuration projecting radially outwardly around a central shaft. Such an arrangement of rotor blades is referred to as a rotor blade assembly. A multi-stage compressor or a multi-stage turbine have a plurality of rotor blade assemblies. Provided both between the individual rotor blade assemblies of a compressor or a turbine and also upstream of the first rotor blade assembly and downstream of the last rotor blade assembly there are usually guide blade assemblies which are each also formed by a plurality of radially extending but fixedly arranged guide blades.

Turbojet propulsion units as are used for driving aircraft usually have both a multi-stage compressor and also a multi-stage turbine. The compressor sucks air into the propulsion unit and compresses it. In that situation air flows substantially in the axial direction through the compressor and passes in the compressed condition into one or more combustion chambers. There, the compressed air is mixed with fuel and the fuel is burnt. That results in a further increase in pressure in the combustion chamber. The gases flow out of the combustion chamber into a turbine in which they expand and give off their energy to the rotor blades of the rotor blade assemblies. The rotor blade assemblies of the turbine are connected to a turbine shaft and drive it. The turbine shaft transmits its energy to the shaft of the compressor and in addition possibly to a propeller, a fan or another consumer of mechanical energy. The turbine of a turbojet propulsion unit also has fluid flowing therethrough substantially axially and parallel to the turbine shaft.

Gaps are respectively provided between the radially free ends of the stationary guide blade assemblies of a compressor or a turbine and the rotating rotor on the one hand and between the radially free ends of the moving rotor blades and the stationary housing surrounding the respective rotor blade assembly on the other hand, so that the stationary guide blades do not touch moving parts and the rotating rotor blades do not touch stationary parts of the compressor or the turbine. The magnitude of those gaps is one of the decisive criteria in regard to the operating characteristics and the overall efficiency of the turbine or the compressor. Large gap sizes or different gap dimensions in relation to the individual blades of the guide blade assemblies or the rotor blade assemblies have an adverse effect. In a conventional arrangement with a central rotor, the inwardly facing free ends of the guide blade assemblies and the outwardly facing free ends of the rotor blades must be subjected to fine machining after assembly of the blades. As the blades are generally secured to the housing of the rotor in a way which permits a slight degree of mobility of the blades, they must be moved into a stable position for the fine machining procedure after assembly. The fine machining procedures involves the assembled blades being fixed and ground. In order to achieve a blade position which is appropriate to the function involved, the individual blades should be prestressed during the final grinding operation.

As the spaces between the respective propulsion unit stages are very slight and there is a requirement for a vibration-free grinding operation, it is known and conventional for the air guide blades of one-piece compressor housings of jet propulsion units to be cast by means of a setting wax, to be fixed thereby, and then to be machined. The amount of time involved in setting up the wax and removing the wax amounts to more than 30 hours for five stages of a housing. The amount of time involved is correspondingly greater when dealing with housings with more stages.

In addition DE 34 02 066 discloses an arrangement for fixing rotor blades, which is distinguished in that the blades of a rotor blade assembly can be prestressed by means of a pressure medium and the prestressing force produced by the pressure medium is associated with each blade of the rotor blade assembly. Equal distribution of the prestressing force produced by the pressure medium is achieved by the known equal distribution of the hydrostatic pressure in a fluid. The use of compressed air as the fluid is described. It has been found that the fluid has an undesirable tendency to transmit oscillations and vibrations which occur in the grinding operation on one blade to the other blades. The arrangement therefore does not satisfy the requirement for grinding the blade ends, in a manner which is as free from vibration as possible. Even worse is the fact than an uncontrollable—even slight—pressure drop results in flaws and defects in the grinding operation and has the consequence of rendering useless the rotor blade assembly, with corresponding high costs.

The object of the present invention is to provide an apparatus for supporting blades, in particular of a jet propulsion unit, which permits propulsion unit blades which are to be machined to be fixed in the most advantageous possible fashion, and which very substantially avoids the disadvantages of the state of the art.

SUMMARY OF INVENTION

In accordance with the invention that object is attained by an apparatus of the kind set forth in the opening part of this specification, which is distinguished by at least one pair of axially mutually oppositely disposed support rings which are supported adjustably relative to each other for assembly between guide or rotor blades of adjacent compressor or turbine stages.

One of those support rings bears in the assembled condition for example against the end edges of all blades of a guide blade assembly or rotor blade assembly of a turbine or a compressor, while the other support ring bears against the nose edges of all blades of a guide blade assembly or rotor blade assembly of the adjacent stage of the turbine or compressor. The rotor blade assembly or guide blade assembly disposed between the adjacent guide blade or rotor blade assemblies is in the meantime removed. The two support rings bear in the axial direction against each other with an adjustable force and in that way prestress the blades of the adjacent guide blade or rotor blade assemblies, with an adjustable force.

The support rings are preferably segmented in the peripheral direction. In that way the support rings can be dismantled and can be easily fitted in particular in one-piece compressor housings.

The support rings preferably bear adjustably against each other by means of a plurality of support elements which are distributed over the periphery of the support rings. For that purpose each support element preferably includes at least one respective clamping pin or bolt and two clamping portions whose mutual spacing is adjustable by means of the clamping bolt. The clamping portions each preferably have two flat clamping bevels which extend at an angle relative to each other and the support rings each preferably have laterally delimited co-operating bevels against which the clamping bevels bear. The clamping elements can then be arranged in such a way that the clamping portions move towards each other when the bolt connecting them is tightened and at the same time by way of their clamping bevels they spread the two mutually oppositely disposed supports rings by virtue of the clamping bevels of the clamping portions sliding along the corresponding co-operating bevels of the support rings and urging the support rings apart. The flat clamping bevels with also flat co-operating bevels which extend in parallel relationship therewith on the support rings ensure a large surface area for transmission of the pressure forces which are transmitted by the clamping portions to the support rings. In addition the clamping portions cannot turn. Finally, the parallelism of the clamping and co-operating bevels guarantees a uniform clamping action and tilting of the support ring segments is excluded.

Preferably at least some segments of a support ring are provided at the side thereof which is towards the blades with an elastic covering which prevents damage to the blades and possibly compensates for tolerances.

Preferably two mutually oppositely disposed segments of a pair of support rings are loosely connected together by connecting elements. The connecting elements are preferably round pins which are received by bores in the mutually oppositely disposed segments. The connecting elements prevent the oppositely disposed segments from falling apart and thus facilitate assembly of the support rings.

Particularly good working results are achieved with a method of machining the free ends of guide or rotor blades of axial-flow machines by means of the support apparatus according to the invention, wherein the blades together with a housing or rotor carrying same are fitted into a receiving apparatus and the support rings are so assembled between the guide or rotor blades of adjacent compressor or turbine stages and upstream of the first stage thereof and the last stage thereof in such a way that the support forces caused by the support arrangements are received and carried by the receiving apparatus. Preferably in that case the housing which is to be machined or the rotor which is to be machined is fitted into the receiving apparatus, with the center line disposed perpendicularly. In the last-mentioned alternative form of the method, the receiving apparatus and the support arrangement are preferably initially pre-assembled and after pre-assembly of all support rings has been implemented, firstly the lowermost support ring and then progressively upwardly all further support rings are set to a desired support force.

The method is particularly suitable more especially in its preferred alternative embodiments for ensuring rapid and precise support of all blades which are to be machined.

The invention will now be described in greater detail by means of an embodiment with reference to the accompanying drawings.

DETAILED DESCRIPTION OF DRAWINGS

Figure 4:
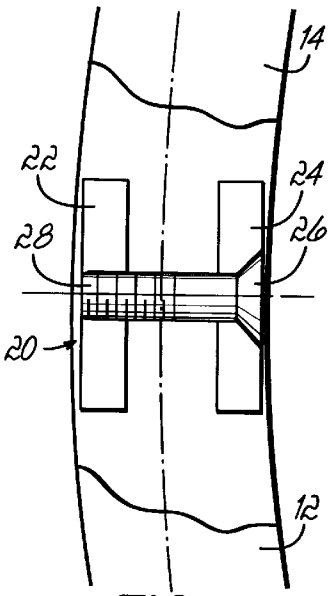
Figure 2:
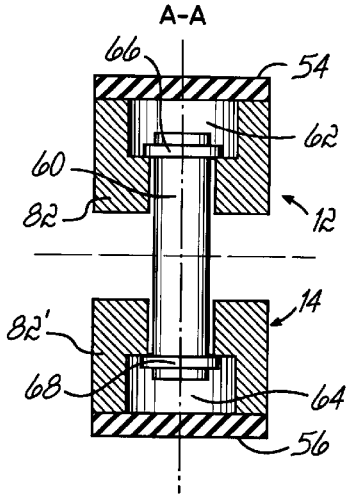
Figure 3:
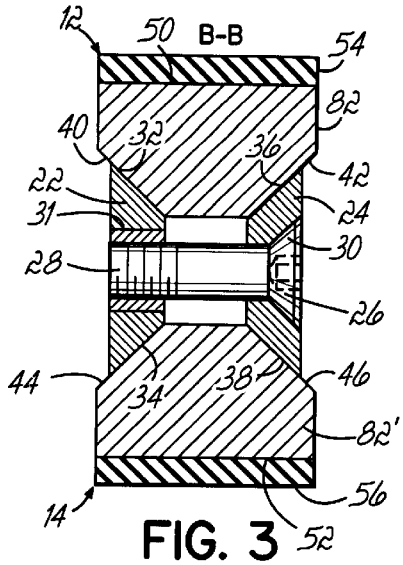
Figure 5:
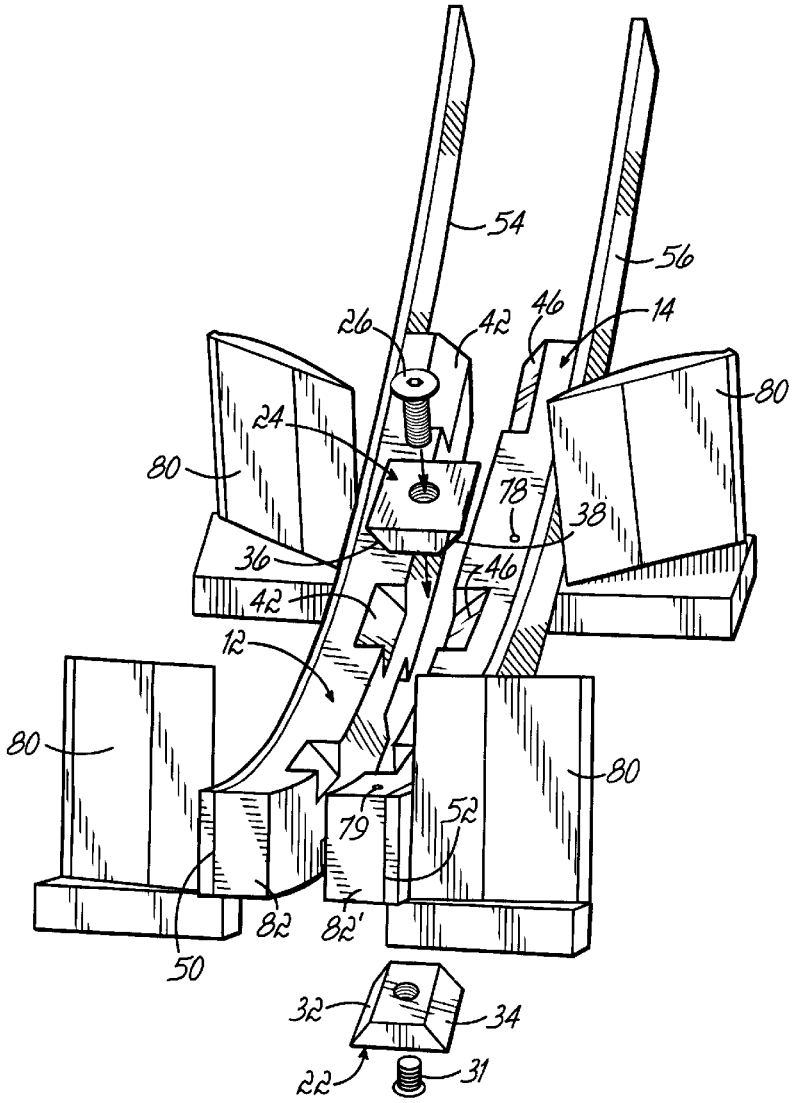
Figure 6:
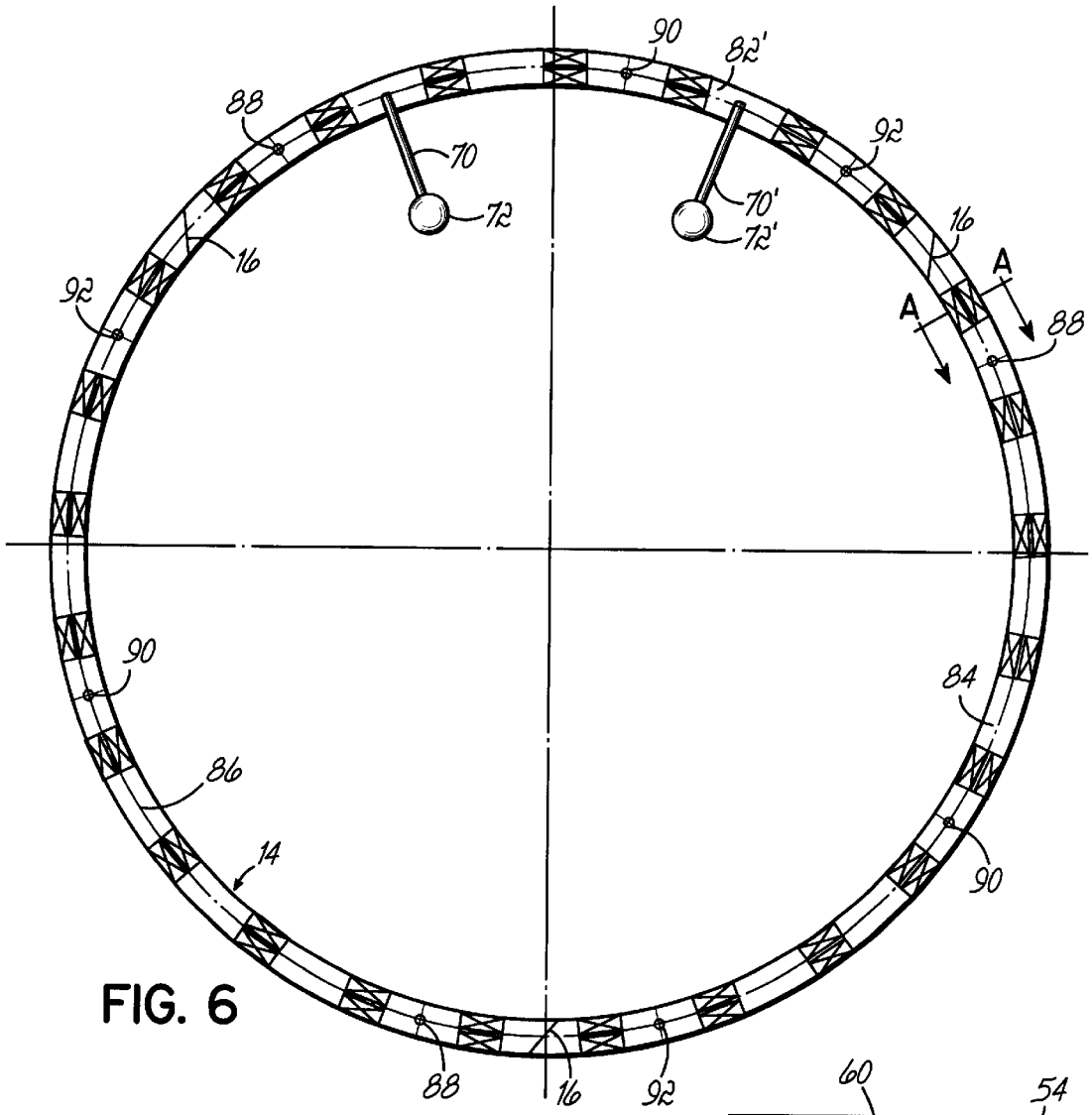
Figure 7:
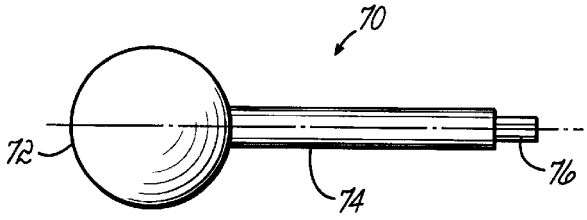
Figure 8:
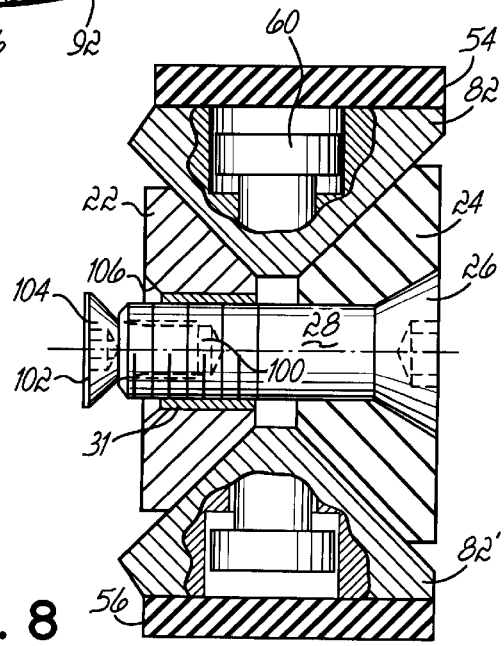

FIG. 1 is a side view of a supporting apparatus,

FIG. 2 shows the section identified by A—A through the support apparatus in FIG. 1, FIG. 3 shows the section identified by B—B through the support apparatus in FIG. 1, FIG. 4 shows the detail indicated at X in FIG. 1 on an enlarged scale, FIG. 5 is a diagrammatic perspective view of part of the support apparatus of FIG. 1 during assembly between adjacent stator blade assemblies of a turbomachine, FIG. 6 is a similar side view to FIG. 1 of the support apparatus with screwed-in handles, FIG. 7 is a view on an enlarged scale of one of the handles of FIG. 6, and FIG. 8 is a section similar to FIG. 3 of a modified embodiment.

DETAILED DESCRIPTION OF PREFERRED EMBODIMENT

The support apparatus 10 illustrated in FIG. 1 includes two support rings 12 and 14 of which the second support ring 14 is substantially concealed by the first support ring 12 in the drawing and can be seen only in the region of the detail X as there the first support ring 12 is show in section in the drawing. The two support rings 12 and 14 are of the same dimensions and are of mirror-image construction relative to each other. The two support rings 12 and 14 each comprise three segments 82, 84, 86, as can be seen at the separating lines 16 between the segments.

Arranged between the two support rings 12 and 14 are a plurality of clamping elements 20, in the described embodiment being precisely 27. As those clamping elements are disposed between the two support rings 12 and 14 and are therefore concealed in the drawing by the first support ring 12, the clamping elements 20 are also shown in broken line in the region of the detail X. In the view of the detail X the first support ring 12 is shown in section and therefore permits a view on to the clamping element 20 disposed at that location. As can be seen in particular from the section B—B (FIG. 3), each clamping element 20 includes two clamping portions 22 and 24 which are connected together by way of a screw stud or bolt 26 serving as a clamping stud or bolt. The shank 28 of the screw bolt 26, which is provided with a male screwthread, engages into a female screwthread in the clamping portion 22. A countersink head 30 at the end of the screw bolt 26, which is in opposite relationship to the shank 28, is freely rotatably held in a correspondingly shaped opening in the second clamping portion 24. The countersink head 30 is provided with a recess for a hexagonal tool for turning the screw bolt 26. The spacing of the two clamping portions 22 and 24 from each other can be reduced by the screw bolt 26 being screwed further into the first clamping portion 22 by means of the male screwthread on its shank 28. The female screwthread in the clamping portion 22 is formed by a self-securing screwthreaded insert 31. That ensures that the screw bolt 26 cannot come loose of its own accord.

The two clamping portions 22 and 24 are each provided with two clamping bevels 32, 34, 36, and 38. Those clamping bevels 32, 34, 36 and 38 are each in the form of respective flat surfaces and bear against correspondingly inclined co-operating bevels 40, 42, 44 and 46 on the support rings 12 and 14. When the screw bolt 26 of a clamping element 20 is tightened, the two clamping portions 22 and 24 of that clamping element 20 move towards each other. When that happens, the clamping bevels 32, 34, 36 and 38 of the clamping portions 22 and 24 slide along the corresponding co-operating bevels 40, 42, 44 and 46 of the two support rings 12 and 14 and at the same time urge the two support rings 12 and 14 away from each other, by virtue of the corresponding inclination of the clamping and co-operating surfaces. In this case, the flag configuration of the clamping and co-operating bevel surfaces is of particular advantage in comparison for example with a conical configuration, because the flat surfaces substantially contribute to the spreading movement of the support rings which occurs when the screw bolts are tightened taking place in very substantially parallel relationship, while in addition there is no need for means for preventing the clamping portions 24 from turning.

The outside surfaces 50 and 52 of the support rings 12 and 14, which are intended to bear against guide or rotor blades of a turbomachine, are each provided with an elastic coating or covering 54 and 56. That elastic covering is intended to prevent damage to the blades and compensate for manufacturing inaccuracies.

FIG. 2 shows the way in which mutually oppositely disposed segments 82, 82' of the two support rings 12 and 14 are loosely connected together so that they do not fall apart in the assembly operation while nonetheless retaining their relative mobility which is necessary for adjustment by means of the clamping elements 20. Both support rings 12 and 14 have through bores, through which projects a connecting pin 60. The connecting pin 60 terminates at both ends in corresponding recesses 62 and 64 in the support rings 12 and 14. Two spring rings or circlips 66 and 68—one at each end of the connecting pin 60—prevent the ends of the connecting pin 60 from being able to slip through the bores in the support rings 12 and 14 and out of the recesses 62 and 64. Moreover the connecting pin 60 is freely movable in the through bores in the support rings 12 and 14 so that the support rings 12 and 14 are not prevented by the connecting pin 60 from moving towards each other to any appropriate extent. When the connecting pin 60 is fitted the support rings 12 and 14 however cannot fall apart from each other.

FIG. 5 shows how the support apparatus 10 is assembled between radially inwardly projecting guide blades 80 of the guide blade assembly of two adjacent stages of a compressor. The two support rings 12 and 14 which are only shown in part bear with their respective flat outside surfaces each provided with the elastic covering 54 and 56 against the leading and trailing edges respectively of the guide blades 80. They are braced in that position by means of the clamping elements 20. For that purpose the two clamping portions 22 and 24 of a clamping element 20 are so positioned that their clamping bevels 32, 34, 36 and 38 rest against the corresponding co-operating bevels 40, 42, 44 and 46 of the support rings 12 and 14. It can be seen from FIG. 5 that the co-operating bevels 40, 42, 44 and 46 are not of a circumferentially extending configuration but are delimited laterally for each clamping element 20 so that the position of each clamping element 20 is precisely predetermined. That ensures uniform distribution of the clamping elements 20 over the periphery of the support rings 12 and 14. The clamping element 20 illustrated in FIG. 5 is shown in the manner of an exploded drawing. Therefore, the two clamping portions 22 and 24 and the screw bolt 26 are illustrated individually. It is also possible to see the screwthreaded insert 31 which forms the screwthread in the clamping portion 22. That screwthreaded insert 31 is self-locking.

If the free ends of the guide blades of a one-piece compressor housing with radially inwardly projecting guide blades are to be machined, the compressor housing is fitted with its center line disposed perpendicularly into a receiving apparatus, and fixed therein. Then a first support apparatus 10 formed by a pair of support rings 12 and 14 is placed between the bottom of the receiving apparatus and the lowermost rotor blade assembly of the compressor and the screw bolts 26 of those first two support rings 12, 14 are slightly tightened so that the support apparatus 10 supports the guide blades of that rotor blade assembly against the bottom of the receiving apparatus. Further pairs of support rings 12, 14 are fitted from below upwardly into the intermediate spaces between the guide blade assemblies of the compressor, such intermediate spaces otherwise being occupied by the blade assemblies of the rotor of the compressor, and the clamping elements 20 of the inserted further pairs of support rings 12, 14 are slight prestressed. A pair of support rings 12, 14 is also put on to the uppermost guide blade assembly. This uppermost pair of support rings 12, 14 is supported upwardly against a closure ring of the receiving apparatus, the closure ring being fitted after insertion of the compressor housing into the receiving apparatus. The closure ring of the receiving apparatus extends in plane-parallel relationship with respect to the bottom of the receiving apparatus. In that way the support forces generated by the support apparatus 10, at the intake and outlet of the compressor, can be received and carried by the receiving apparatus.

After the pre-assembly procedure which takes place as described above for all support apparatuses 10 and the receiving apparatus, the support apparatuses 10 are brought to a reference or target clamping level by further defined tightening of the screw bolts of their clamping elements. In that case, the procedure begins with the lowermost support apparatus 10 and the clamping process is continued with that which is disposed thereabove, until finally the uppermost support apparatus 10 is reached. That procedure ensures uniform prestressing of all blades to be machined.

The uppermost and the lowermost support ring do not have any elastic covering on their side which is remote from the blades to be machined and which is towards the bottom or the closure ring of the receiving apparatus, as no damage is to be feared there.

FIG. 7 shows a handle 70 which has a ball 72 for being seized by hand, a shank 74 and, at the free end of the shank, a screwthreaded portion 76. The shank 74 and the ball 72 are fixedly connected together in a manner not shown herein.

It will be seen from FIG. 5 that, in the preferred embodiment, a segment 82' of the support ring 14 is provided with bores 78,79 which extend radially with respect to the support ring and into which the screwthreaded portion 76 of a respective handle 70 can be screwed.

In use the support apparatuses 10 are usually fitted into the compressor housing to be machined in such a way that they are disposed in horizontal planes. It is preferably provided for such cases that the bores 78, 79 are disposed in a segment of the respective lower support ring of a support arrangement; in the illustrated embodiment in FIG. 5, that would be the support ring 14.

FIG. 6 shows the two handles 70, 70' which have been screwed into the segment 82' of the support ring 14. They project radially inwardly into the support apparatus 10, more specifically in the plane of the support ring 14. As the blades of the compressor or turbine, which are to be machined, are respectively above and below the visible support ring in the views in FIGS. 1 and 6 and the shanks 74 of the handles 70, 70' are of a sufficient length, the support ring can be gripped at balls 72, 72' and positioned in the housing. The consequence of the fact that the handles are secured to a segment of the respective bottom support ring 14 is that the complementary support ring 12 of the support apparatus 10, by virtue of the action of the force of gravity, is also carried by the support ring 14 and thus by the two handles 70, 70', without the mutual spacing of the support rings being capable of increasing.

With reference to FIG. 2 it has been explained hereinbefore that mutually oppositely disposed segments 82, 82' of the support rings are connected together be means of one or two connecting pins 60, and that the segments and therewith the support rings can be moved relative to each other and perpendicularly to their planes, within certain limits. FIG. 6 now shows the position of the above-mentioned through bores 88, 90, 92 which are provided in each of the segments which are disposed in mutually superposed relationship in FIG. 6. It will be seen that two through bores are provided in the proximity of each of the separating lines 16 and in each case a third through bore is disposed approximately in the center of each support element. All of those bores extend perpendicularly to the plane of the paper in FIG. 6 and thus perpendicularly to the plane of the support rings 12, 14.

A further preferred alternative embodiment as shown in FIG. 8. FIG. 8 once again shows a pair of clamping portions 22, 24 together with a screw bolt 26. The shank 28 of the screw bolt 26 is provided from its free end with a central screwthreaded bore 100 into which is screwed a hexagon socket screw 102 with a countersink head 104. Unlike the embodiment shown in FIG. 3 the free end of the shank 28 in the embodiment of FIG. 8 projects a certain distance beyond the free surface of the clamping portion 22. The countersink head 104 is of a larger diameter than the shank 28. It is imagined that the screw bolt 26 is screwed out of the clamping portions (towards the right in FIG. 8), it will be seen that, after the screw bolt 28 has covered a certain distance, the outer edge of the countersink head 104 of the screw 102 moves into a countersink 106 in the clamping portion 24 and comes into a condition of abutment there. The consequence of this structure is that, when the screw bolt 26 is loosened, the two clamping portions can be moved away from each other only by a certain amount and cannot fall out upon assembly and dismantling of the support arrangement.

We claim:

1. An apparatus for supporting blades of axial-flow machines comprising:

at least one pair of mutually oppositely disposed support rings adapted for assembly in between guide or rotor blades of adjacent compressor or turbine stages, said support rings being selectively moveable relative to each other between a first non-engaged position and a second engaged position, wherein said support rings are adapted to contact the guide or rotor blades when said support rings are moved to said second engaged position.

2. The support apparatus of claim 1 wherein said support rings are segmented about a periphery of said support rings.

3. The support apparatus of claim 1 further comprising a plurality of clamping elements distributed over a periphery of said support rings, said clamping elements operative to move said support rings between said first non-engaged position and said second engaged position.

4. The support apparatus of claim 3 wherein each of said clamping elements includes at least one clamping bolt and two clamping portions, said clamping bolt adapted to adjust the spacing between said clamping portions whereby the support rings are moved between said first non-engaged position and said second engaged position.

5. The support apparatus of claim 4 wherein each of said clamping portions has two clamping bevels which are formed by flat surfaces and which extend at an angle relative each other.

6. The support apparatus of claim 5 wherein each of said support rings has laterally delimited flat cooperating bevels which extend parallel to said clamping bevels of said clamping portions, said cooperating bevels approach each other with a decreasing distance from the center point of said support rings.

7. The support apparatus of claim 4 wherein said clamping bolt has a shank with a free end, said shank includes a central threaded bore, said free end projecting out of said clamping portion, a screw threadingly engaging said threaded bore, said screw having a head larger than the diameter of said shank, said head engaging said clamping portions to prevent separation of said clamping portions.

8. The support apparatus of claim 1 wherein each of said support rings is formed from mutually oppositely disposed segments, the support apparatus further including connecting elements operative to connect said mutually oppositely disposed segments.

9. The support apparatus of claim 8 wherein said connecting elements are round pins and the mutually oppositely disposed segments have bores for receiving said round pins.

10. The support apparatus of claim 9 wherein at least one segment of at least one of said support rings includes a handle for manually gripping the support apparatus.

11. The support apparatus of claim 10 wherein said handle includes a ball and a shank, said shank being removably connected to at least one of said support rings from a radially inwardly disposed side of the support apparatus.

12. A method for supporting the free ends of rotor blades fixed in a receiving apparatus using a support apparatus having a pair of mutually oppositely disposed support rings, the support rings being selectively moveable relative to each other between a first non-engaged position and a second engaged position, the method comprising the steps of:

placing support rings in a first non-engaged position between rotor blades of adjacent stages in the receiving apparatus; and adjusting said support rings to a second engaged position to fixedly hold the rotor blades.

13. The method of claim 12 wherein the rotor blades are disposed perpendicularly to the receiving apparatus.

14. The method of claim 13 wherein the receiving apparatus and the support apparatus are initially preassembled and slightly prestressed, the method further comprising the step of:

selectively engaging said support rings with clamping elements to apply a desired support force to the rotor blades.

15. An apparatus for supporting blades of axial-flow machines comprising:

at least one pair of mutually oppositely disposed support rings which are supported adjustably relative to each other for assembly between guide or rotor blades of adjacent compressor or turbine stages, at least one of said support rings includes an elastic covering disposed on a side of said support ring, said elastic covering adapted to bear against the guides or rotor blades of the axial-flow machine.

16. The support apparatus of claim 15 further comprising a plurality of clamping elements distributed over a periphery of said support rings to adjustably support said support rings relative to each other.

17. The support apparatus of claim 16 wherein each of said clamping elements includes at least one clamping bolt and two clamping portions, said clamping bolt adapted to adjust the spacing between said clamping portions.

18. The support apparatus of claim 17 wherein each of said clamping portions has two clamping bevels which are formed by flat surfaces and which extend at an angle relative each other.

19. The support apparatus of claim 18 wherein each of said support rings has laterally delimited flat cooperating bevels which extend parallel to said clamping bevels of said clamping portions, said cooperating bevels approach each other with a decreasing distance from the center point of said support rings.

20. The support apparatus of claim 17 wherein said clamping bolt has a shank with a free end, said shank includes a central threaded bore, said free end projecting out of said clamping portion, a screw threadingly engaging said threaded bore, said screw having a head larger than the diameter of said shank, said head engaging said clamping portions to prevent separation of said clamping portions.

21. The support apparatus of claim 15 wherein said support rings are segmented about a periphery of said support rings.

22. The support apparatus of claim 15 wherein each of said support rings is formed from mutually oppositely disposed segments, the support apparatus further including connecting elements operative to connect said mutually oppositely disposed segments.

23. The support apparatus of claim 22 wherein said connecting elements are round pins and the mutually oppositely disposed segments have bores for receiving said round pins.

24. The support apparatus of claim 23 wherein at least one segment of at least one of said support rings includes a handle for manually gripping the support apparatus.

25. The support apparatus of claim 24 wherein said handle includes a ball and a shank, said shank being removably connected to at least one of said support rings from a radially inwardly disposed side of the support apparatus.

* * * * *